US007170373B2

(12) United States Patent
Ito et al.

(10) Patent No.: US 7,170,373 B2
(45) Date of Patent: Jan. 30, 2007

(54) DIELECTRIC WAVEGUIDE FILTER

(75) Inventors: Masaharu Ito, Tokyo (JP); Kenichi Maruhashi, Tokyo (JP); Keiichi Ohata, Tokyo (JP)

(73) Assignee: NEC Corporation, Tokyo (JP)

( * ) Notice: Subject to any disclaimer, the term of this patent is extended or adjusted under 35 U.S.C. 154(b) by 5 days.

(21) Appl. No.: 10/502,782

(22) PCT Filed: Jan. 31, 2003

(86) PCT No.: PCT/JP03/00982

§ 371 (c)(1),
(2), (4) Date: Jul. 28, 2004

(87) PCT Pub. No.: WO03/067701

PCT Pub. Date: Aug. 14, 2003

(65) Prior Publication Data

US 2005/0156688 A1 Jul. 21, 2005

(30) Foreign Application Priority Data

Feb. 4, 2002 (JP) ..... 2002-027072

(51) Int. Cl.
*H01P 1/208* (2006.01)
*H01P 3/16* (2006.01)

(52) U.S. Cl. ..... 333/208; 333/239

(58) Field of Classification Search ..... 333/202, 333/208, 209, 212, 239, 248
See application file for complete search history.

(56) References Cited

U.S. PATENT DOCUMENTS 4,246,555 A * 1/1981 Williams ..... 333/209

(Continued)

FOREIGN PATENT DOCUMENTS

JP 03-212003 8/1991

(Continued)

OTHER PUBLICATIONS

Ito et al, "60-GHz-band Dielectric Waveguide Filters with Cross-coupling for Flip-chip Modules", Microwave Symposium Digest, 2002 IEEE MTT-S International, vol. 3, Jun. 2-7, 2002, pp. 1789-1792.*

(Continued)

*Primary Examiner*—Seungsook Ham
(74) *Attorney, Agent, or Firm*—Whitham, Curtis, Christofferson & Cook, P.C.

(57) ABSTRACT

A conductive layer is formed on each of the upper and lower surfaces of a dielectric substrate, and the two conductive layers are connected by rows of via-holes that are formed which a spacing that is less than or equal to ½ of the wavelength in the dielectric substrate in the resonance frequency, whereby n stages of dielectric resonators and input/output waveguide structures are formed. If the number n of stages is assumed to be 3, the first-stage resonator and the second-stage resonator are coupled by an electromagnetic field by means of via-holes of a first spacing; the second-stage resonator and the third-stage resonator are coupled by an electromagnetic by means of via-holes of a second spacing, whereby a filter is formed. The input/output waveguide structure and the filter are coupled by an electromagnetic by means of via-holes of a fourth spacing. The first-stage resonator and the third-stage resonator are coupled by an electromagnetic field by means of via-holes of a third spacing.

8 Claims, 6 Drawing Sheets

U.S. PATENT DOCUMENTS 6,160,463 A * 12/2000 Arakawa et al. ..... 333/202
6,927,653 B2 * 8/2005 Uchimura et al. ..... 333/208

FOREIGN PATENT DOCUMENTS

JP 11-284409 10/1999
JP 11-355010 12/1999
JP 2002-26610 1/2002
JP 2002-026611 1/2002

OTHER PUBLICATIONS

Ito et al, "60-GHz-Band Planar Dielectric Waveguide Filters for Flip-Chip Modules", IEEE Trans. on Microwave Theory & Tech., vol. 49, No. 12, Dec. 2001, pp. 2431-2436.*
Japanese Office Action dated Feb. 1, 2005 with English translation of pertinent portions.

* cited by examiner

DIELECTRIC WAVEGUIDE FILTER

TECHNICAL FIELD

The present invention relates to a dielectric waveguide filter that has an upper conductive layer and a lower conductive layer on the surfaces of a dielectric substrate, wherein a row of via-holes or conductors that connect the upper conductive layer and lower conductive layer is used to form resonators and dielectric windows.

BACKGROUND ART

There exists a need for filters that feature low loss and a steep out-of-band suppression characteristic, and further, that feature compact size and connectability with a planar circuit. From the standpoint of connection reproducibility and low parasitic inductance at high frequencies, it is also strongly desired that such filters allow flip-chip packaging. One filter having these characteristics is shown in FIG. 1 and described in the public literature in a paper by M. Ito et al. (IEEE International Microwave Symposium Digest, pp. 1597–1600, May 2001). FIG. 1A is a plan view of this known example of a filter, and FIG. 1B is a sectional view taken along alternate long and short dash line E–E' in FIG. 1A. Conductive layers 2*a* and 2*b* are formed on the upper and lower surfaces of dielectric substrate 1, and these upper and lower conductive layers 2*a* and 2*b* are connected by via-hole rows 3*a* that are formed such that spacing Ip in the direction of signal propagation is less than or equal to ½ of the guide wavelength, whereby a waveguide is formed. A waveguide filter is achieved by forming via-holes 3*b* that constitute dielectric windows within this waveguide at spacing $I_1$, $I_2$, $I_3$, $I_4$ that is equal to or less than ½ of the guide wavelength. In addition, waveguide-coplanar converters 10 are formed over the first-stage and final-stage resonators, these waveguide-coplanar converters being connected to input/output coplanar lines that are made up of ground conductive layer 2*a* and signal conductive layer 2*c*. Finally, to improve the out-of-band suppression characteristic, coplanar resonators 15 that provide a bandwidth elimination characteristic are connected to waveguide-coplanar converters 10.

When fabricating the filter of the above-described known example using a ceramic as the dielectric substrate, via-holes were formed by punching before sintering the green sheet, and a conductive pattern was formed after sintering. As a result, misregistration between the via-holes and the conductive pattern tends to occur due to the degree of control of the coefficient of contraction during sintering. With the filter of this known example, due to a coupling by an electromagnetic field between coplanar resonators 15 and the dielectric resonators that constitute the filter, the filter characteristics are highly sensitive to misregistration between via-holes 3*a* and 3*b* and upper conductive layer 2*a*, as shown in FIG. 6. As a consequence, problems are encountered in fabrication such as a high degree of variability in performance and low yield.

DISCLOSURE OF THE INVENTION

It is an object of the present invention to provide a dielectric waveguide filter that is capable of forming out-of-band attenuation poles without additionally forming openings for interlaced electromagnetic field coupling.

According to a first aspect of the invention, in a dielectric waveguide filter that has an upper conductive layer and a lower conductive layer on the surfaces of a dielectric substrate, and conductors that connect the upper conductive layer and the lower conductive layer to form n filter stages comprising resonators and dielectric windows, the number n of filter stages is 3 or more, and the first to $n^{th}$ resonators are successively coupled by electromagnetic fields and adjacent to respective resonators such that the $i^{th}$ resonator is coupled to the $j^{th}$ resonator by an electromagnetic field, where i. j. and n are integers such that $1 \leqq i < j \leqq n$ and $j \neq i+1$.

By two-dimensionally arranging resonators that are surrounded by via-holes, out-of-band attenuation poles can be formed without additionally providing openings for interlaced electromagnetic field coupling. As a result, the out-of-band suppression characteristic can be improved, the number of filter stages can be reduced, and a more compact device can be realized.

The formation of waveguide-coplanar converters on the dielectric resonators of the input and output stages of the filter enables flip-chip packaging. In addition, there is no need for providing openings on resonators other than the input and output stages, and this configuration is therefore less prone to misregistration between the conductive layers and via-holes during fabrication.

According to an embodiment of the present invention, resonators are formed by rows of via-holes that connect the upper and lower conductive layers that are formed on the surfaces of the dielectric substrate, and the spacing of the via-holes that form the via-hole rows is less than or equal to ½ of the guide wavelength of the resonance frequency.

According to an embodiment of the present invention, planar lines made up of slots are formed on the upper conductive layer and/or the lower conductive layer on the surfaces of the dielectric substrate.

According to another embodiment of the present invention, the planar lines are coplanar lines made up of two coupled slots.

According to another aspect of the present invention, in a dielectric waveguide filter that has an upper conductive layer and a lower conductive layer on the surfaces of a dielectric substrate, and rows of via-holes that connect the upper conductive layer and the lower conductive layer to form resonators and dielectric windows, the spacing of the via-holes that form via-hole rows is equal to or less than ½ the waveguide wavelength of the resonance frequency, and for at least one via-hole of the via-hole rows, a slot is formed so as to surround the periphery of the via-hole in the upper conductive layer and/or the lower conductive layer, and a conductive tab is used to connect the two conductive layers with each other across the slot.

According to an embodiment of the present invention, the filter is flip-chip packaged, and conductive tab and bumps that are formed on the substrate for flip-chip packaging are used to connect the conductive layers on both sides across slots that are formed surrounding the peripheries of via-holes.

According to an embodiment of the present invention, the number n of filter stages is 3 or more, and the first to $n^{th}$ resonators are successively coupled by electromagnetic fields such that the $i^{th}$ resonator is coupled to the $j^{th}$ resonator by an electromagnetic field, where $j \neq i \pm 1$.

According to an embodiment of the present invention, planar lines are made up of slots are formed in the upper conductive layer and/or the lower conductive layer on the surfaces of the dielectric substrate.

According to the embodiment of the present invention, the planar lines are coplanar lines made up of two coupled slots.

BEST MODE FOR CARRYING OUT THE INVENTION

Figure 2A:
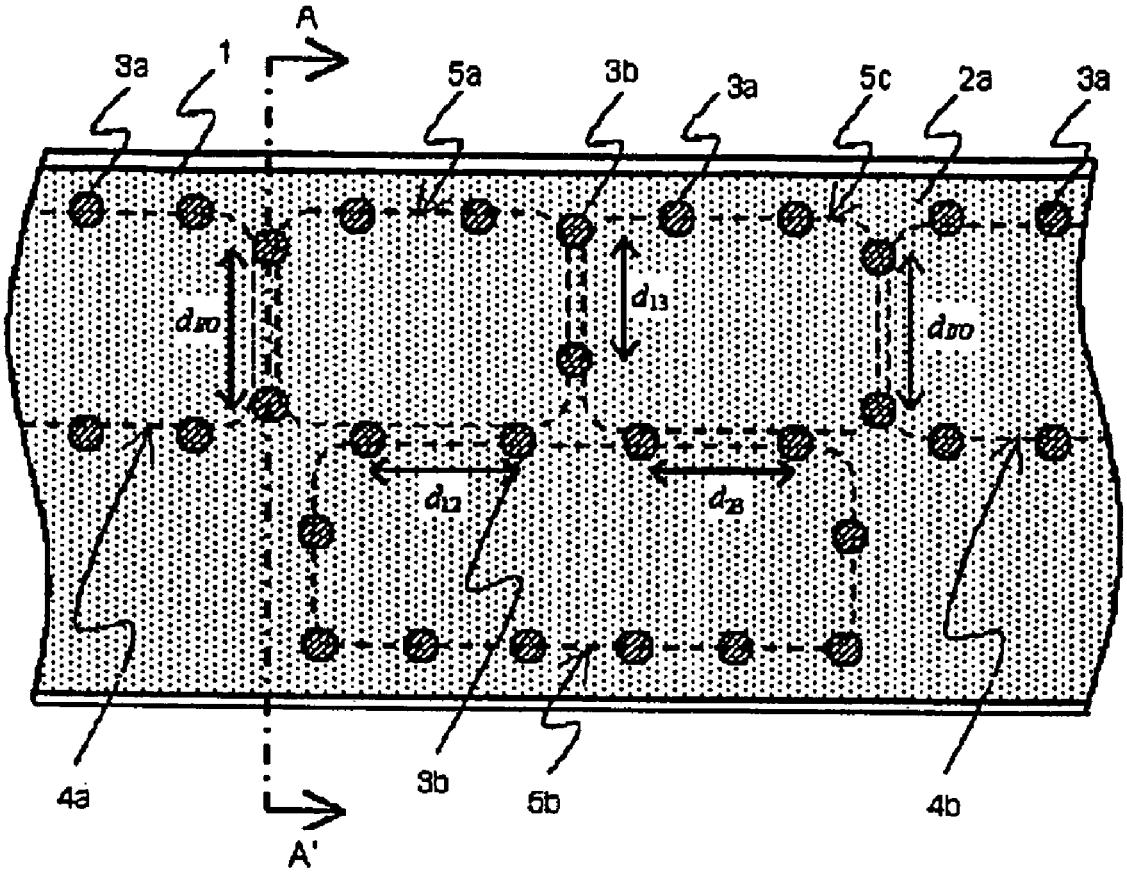
FIG. 2 shows the configuration of a first embodiment according to the present invention, FIG. 2A showing a plan view of the filter substrate and FIG. 2B showing a sectional view taken along alternate long and short dash line A–A' of FIG. 2A.
Figure 2B:
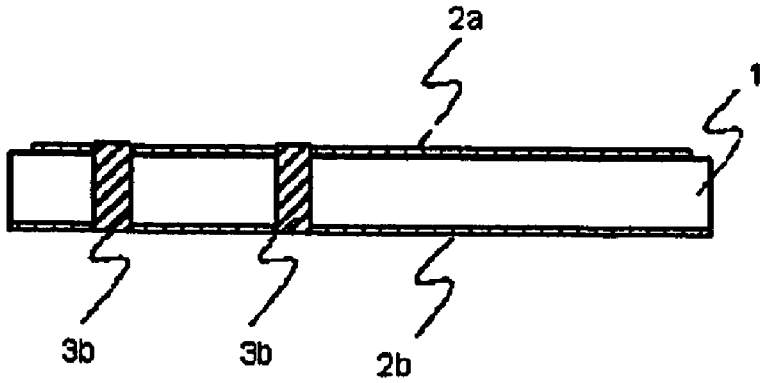

A first embodiment according to the present invention will now be explained in detail with reference to FIG. 2. FIG. 2A is a plan view of a filter substrate, and FIG. 2B is a sectional view taken along alternate long and short dash line A–A' in FIG. 2A.

Figure 1A:
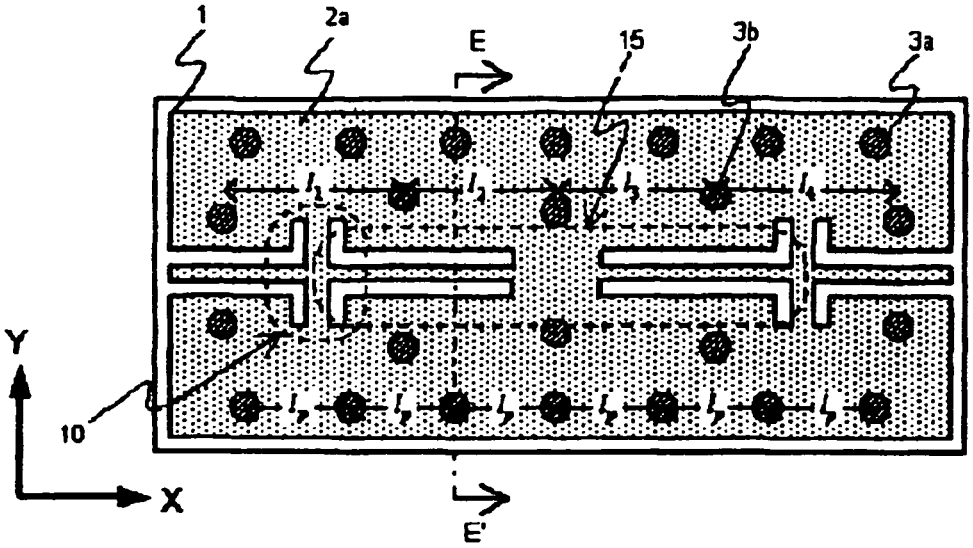
Fig. 1A PRIOR ART
FIG. 1 shows the configuration of a waveguide filter of the prior art, FIG. 1A being a plan view of the filter substrate, and FIG. 1B being a sectional view taken along alternate long and short dash line E–E' of FIG. 1A.
Figure 1B:
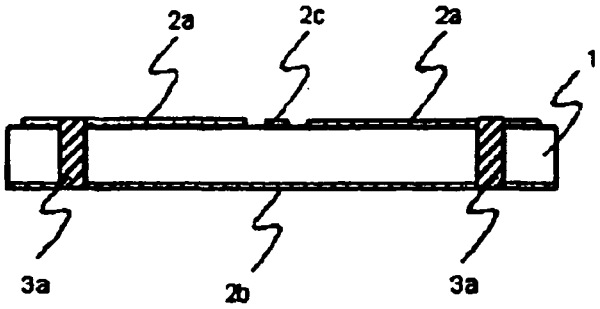
Fig. 1B PRIOR ART
Figure 7:
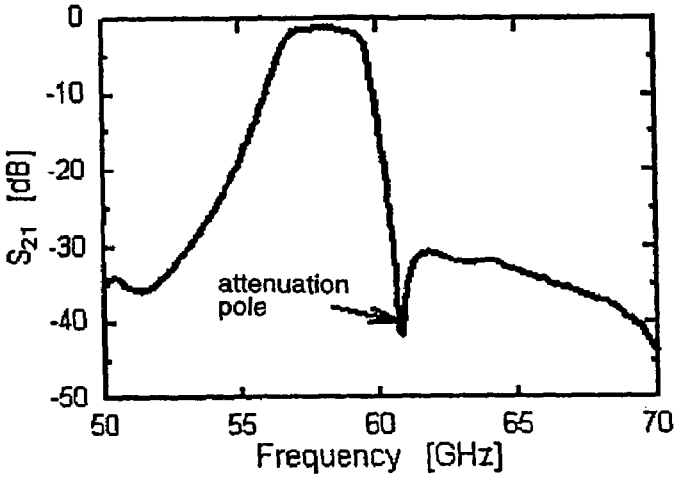
FIG. 7 shows the improvement of the out-of-band suppression characteristic realized by the present invention.
Figure 8:
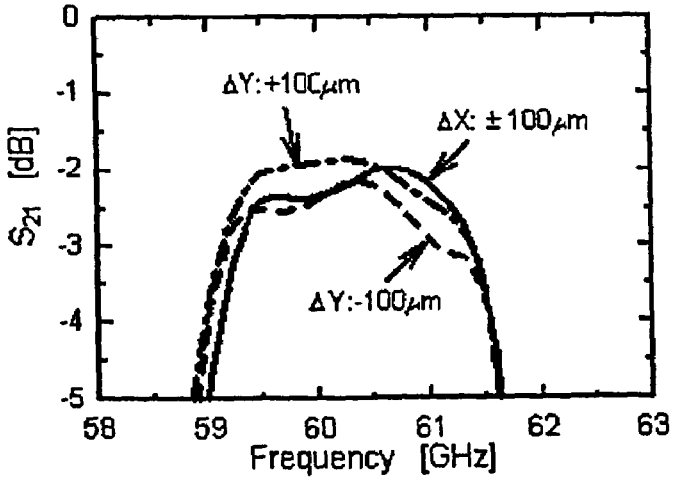
FIG. 8 shows the change in characteristic with respect to misregistration between via-holes and conductive pattern in a filter of the present invention.

Upper and lower conductive layers 2*a* and 2*b* are formed on the upper and lower surfaces of dielectric substrate 1. Upper and lower conductive layers 2*a* and 2*b* are connected each other by via-hole rows 3*a* and 3*b* that are formed with a spacing being equal to or less than ½ of the wavelength in the dielectric substrate at the resonance frequency, whereby first-stage, second-stage, and third-stage dielectric resonators 5*a*, 5*b*, and 5*c* and input/output waveguide structures 4*a* and 4*b* are formed. The filter is configured such that first-stage resonator 5*a* and second-stage resonator 5*b* are coupled by an electromagnetic field by means of dielectric windows in the form of via-holes 3*b* with a spacing being equal to $d_{12}$ and second-stage resonator 5*b* and third-stage resonator 5*c* are coupled by an electromagnetic field by means of dielectric windows in the form of via-holes 3*b* with a spacing being equal to $d_{23}$. Input/output waveguide structures 4*a* and 4*b* and the filter are electromagnetically coupled by dielectric windows in the form of via-holes 3*b* with a spacing being equal to $d_{I/O}$. Two-dimentional arrangement of resonators 5*a*, 5*b*, and 5*c* makes it possible to easily provide coupling by an interlaced electromagnetic field between first-stage resonator 5*a* and third-stage resonator 5*c* by means of dielectric windows in the form of via-holes 3*b* with a spacing being equal to d13. This allows to provide an attenuation pole on the high-frequency side of the pass band, as shown by the transmission characteristic of the filter in FIG. 7, thus improving the out-of-band suppression characteristic. The filter described in the public document shown in FIG. 1 has openings formed thereon that function as coplanar resonators 15 to introduce attenuation poles on the resonators that form the filter, but the filter of the present invention lacks these openings. Thus, as shown in FIG. 8, change in characteristic resulting from misregistration of via-holes 3*a* and 3*b* with respect to conductive layer 2*a* can be adequately controlled. In addition, the filter of the present embodiment can realize coupling by an interlaced electromagnetic field by only the arrangement of via-holes and therefore does not require additional fabrication steps.

Figure 3A:
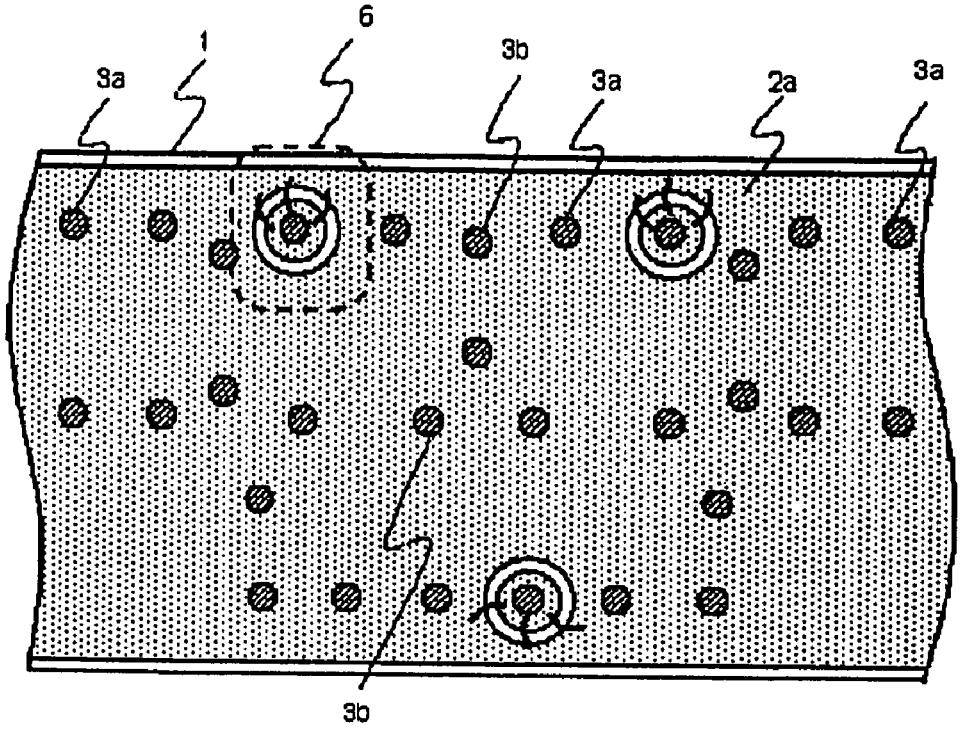
FIG. 3 shows the configuration of a second embodiment according to the present invention, FIG. 3A showing a plan view of the filter substrate, FIG. 3B showing a detailed view of an inductance regulator, and FIG. 3C showing a sectional view taken along alternate long and short dash line B–B' of FIG. 3B.
Figure 3B:
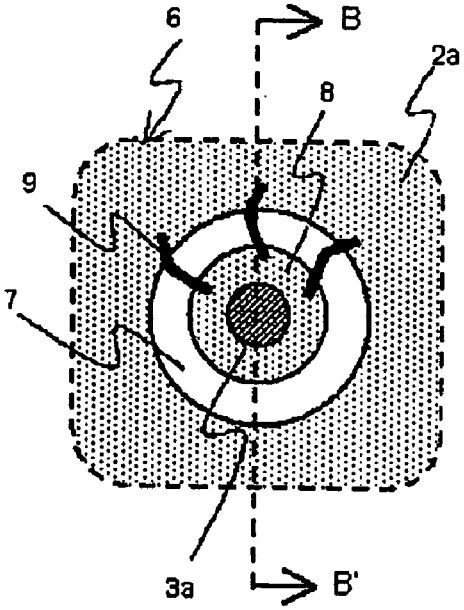
Figure 3C:
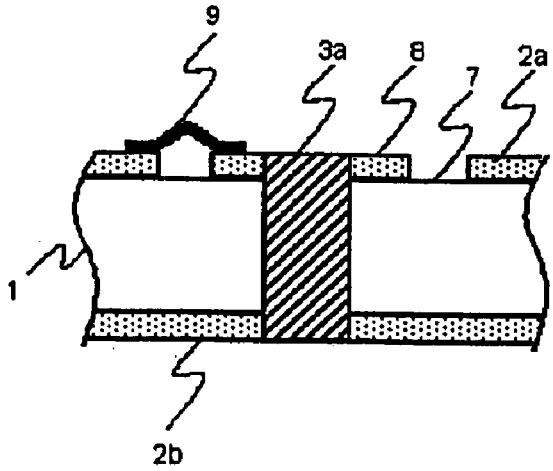

As a second embodiment of the present invention, a configuration that allows regulation of the filter characteristics will be explained with reference to FIG. 3. FIG. 3A is a plan view of the filter substrate, FIG. 3B is a detailed view of the area 6 enclosed by the dotted lines in FIG. 3A, and FIG. 3C is a sectional view taken along alternate long and short dash line B–B' in FIG. 3B.

Forming slot 7 around the periphery of via-hole 3*a* that forms a resonator causes pad 8 to be formed that is electrically isolated from conductive layer 2*a*. This pad 8 and conductive layer 2*a* are connected with each other by, for example, bonding wires 9. The number of wires or their length are regulated to form inductance regulator 6 for regulating the inductance of via-holes 3*a* that form the side walls of the dielectric resonator. Changes in the inductance change the resonance frequency of the dielectric resonator. Accordingly, forming inductance regulator 6 in each resonator stage enables regulation of the center frequency of the filter. In addition, forming inductance regulators 6 at via-holes 3*b* that form the dielectric windows enables regulation of the degree of electromagnetic field coupling between dielectric resonators. In such a case, the bandwidth of the filter can be regulated.

Figure 4A:
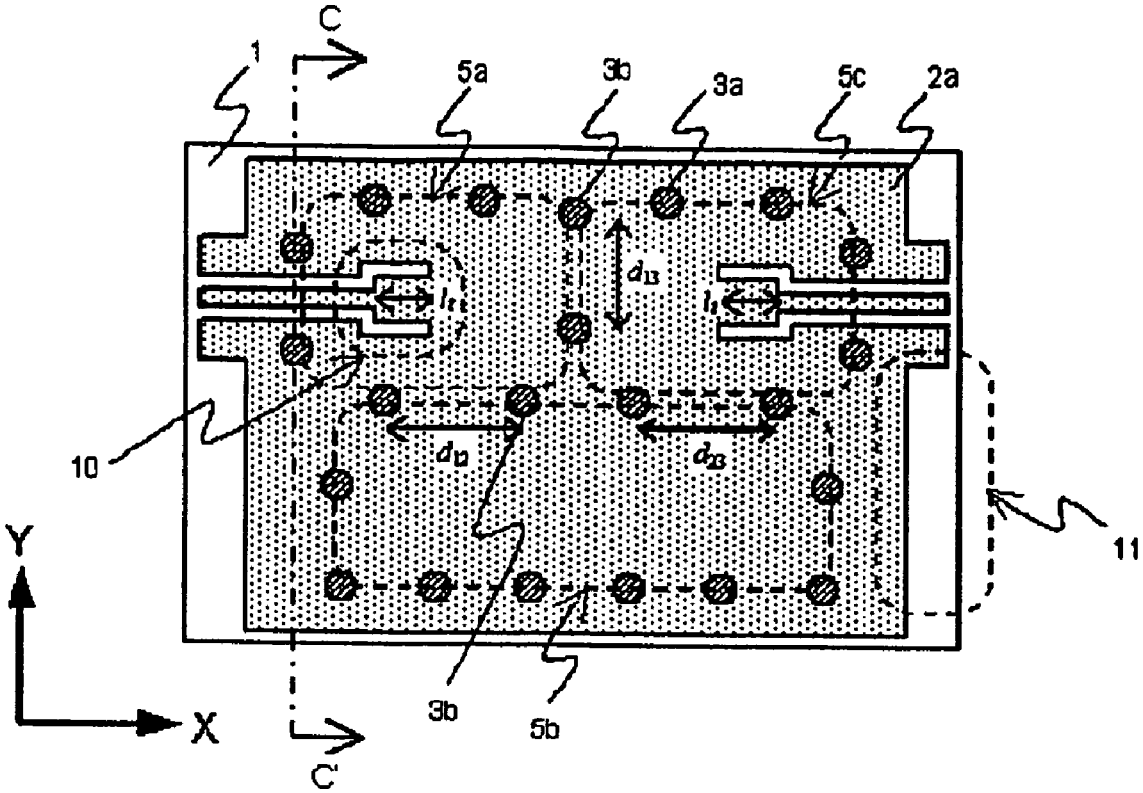
FIG. 4 shows the configuration of a third embodiment according to the present invention, FIG. 4A showing a plan view of the filter substrate, and FIG. 4B showing a sectional view taken along alternate long and short dash line C–C' of FIG. 4A.
Figure 4B:
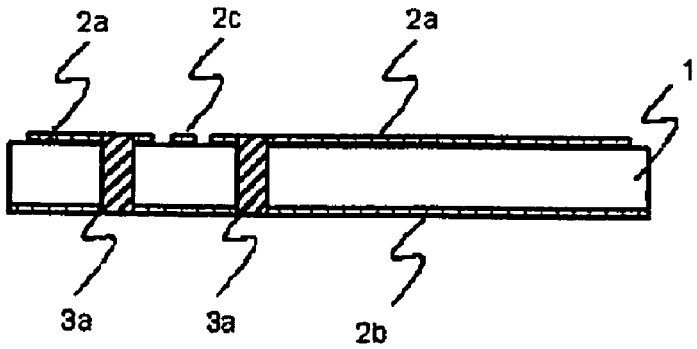

A third embodiment of the present invention will now be explained in detail with reference to FIG. 4. FIG. 4A is a plan view of the filter substrate, and FIG. 4B is a sectional view taken along alternate long and short dash line C–C' in FIG. 4A.

Upper and lower conductive layer 2*a* and 2*b* are formed on the surfaces of dielectric substrate 1. First-stage, second-stage, and third-stage dielectric resonators 5*a*, 5*b*, and 5*c* are formed by connecting these upper and lower conductive layers 2*a* and 2*b* by means of via-hole rows 3*a* and 3*b* that are formed with a spacing being equal to or less than ½ of the wavelength in the dielectric substrate at the resonance frequency. Formed on first-stage resonator 5*a* and third-stage resonator 5*c* are waveguide-coplanar converters 10 that are connected to input/output coplanar lines that are made up of ground conductive layer 2*a* and signal conductive layer 2*c*. The degree of electromagnetic field coupling between input/output stage resonators 5*a* and 5*c* and waveguide-coplanar converters 10 is regulated by the length $I_t$ of waveguide-coplanar converters 10. The filter is configured such that first-stage resonator 5*a* and second-stage resonator 5*b* are coupled by an electromagnetic field by means of dielectric windows in the form of via-holes 3*b* with a spacing being equal to $d_{12}$, and the electromagnetic field second-stage resonator 5*b* and third-stage resonator 5*c* are coupled by dielectric windows in the form of via-holes 3*b* with a spacing being equal to $d_{23}$. The two-dimensional arrangement of resonators 5*a*, 5*b*, 5*c* makes it possible to provide an interlaced electromagnetic field coupling between first-stage resonator 5*a* and third-stage resonator 5*c* by means of the dielectric windows in the form of via-holes 3*b* with a spacing being equal to $d_{13}$. The provision of notches 11 in conductive layer 2*a* of the input/output portions enables a reduction of the emission at the end of the substrate. The adoption of coplanar lines for input and output enables integration of planar circuit such as MMIC (Monolithic Microwave Integrated Circuit) and also enables flip-chip packaging.

In this case as well, the use of a configuration that is similar to the second embodiment allows regulation of the filter characteristics, and the adoption of coplanar lines for input and output further facilitates flip-chip packaging.

Figure 5A:
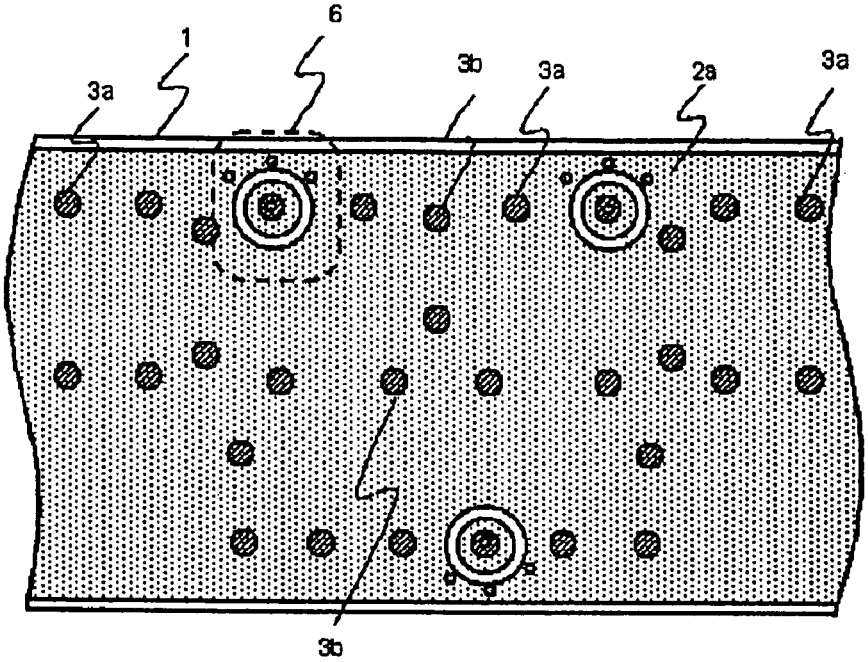
FIG. 5 shows the configuration of a fourth embodiment according to the present invention, FIG. 5A showing a plan view of the filter substrate, FIG. 5B showing a detailed view of an inductance regulator, and FIG. 5C showing a sectional view taken along alternate long and short dash line D–D' of FIG. 5B.
Figure 5B:
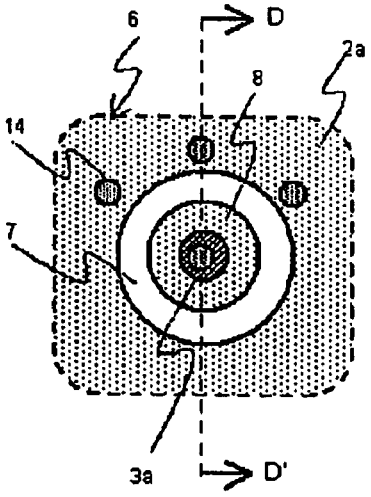
Figure 5C:
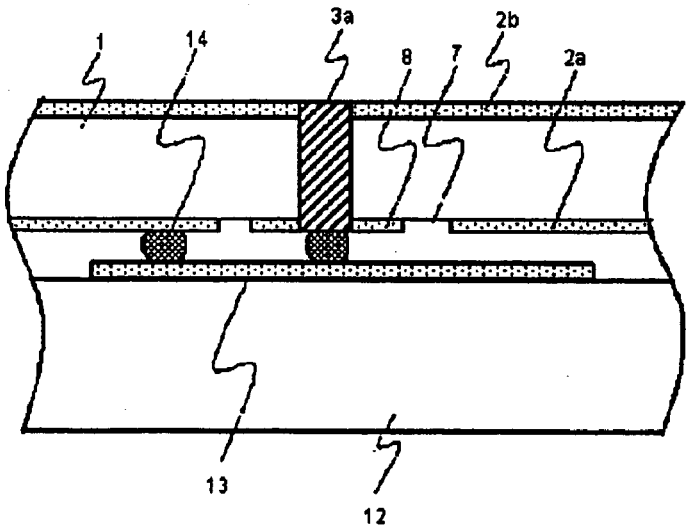
Figure 6:
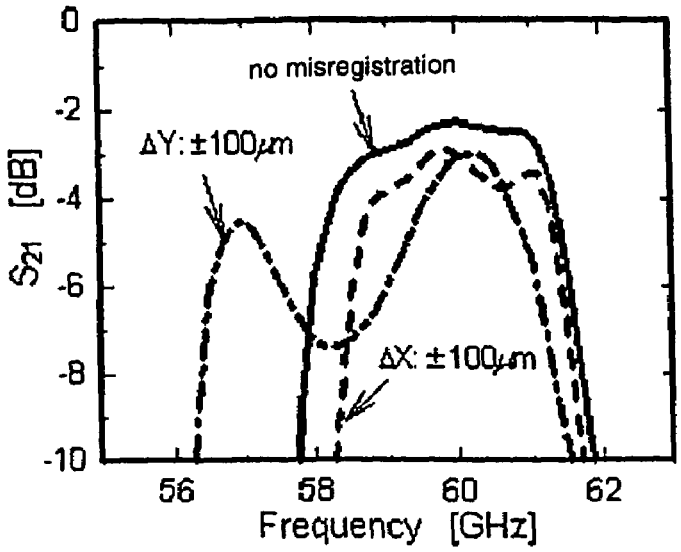
FIG. 6 shows the change in characteristic with respect to the misregistration of via-holes and conductive pattern in the filter of the prior art shown in FIG. 1.

As a fourth embodiment of the present invention, a configuration that regulates filter characteristics using flip-chip packaging, will now be explained with reference to FIG. 5. FIG. 5A is a plan view of the filter substrate, FIG. 5B shows the details of area 6 that is delineated by dotted lines in FIG. 5A, and FIG. 5C is a sectional view taken along alternate long and short dash line D–D' in FIG. 5B. For the sake of illustration, however, flip-chip packaging substrate 12 is not shown in FIGS. 5A and 5B.

Forming slot 7 around the periphery of via-hole 3*a* that forms a resonator causes pad 8 to be formed that is electrically isolated from conductive layer 2*a*. This pad 8 and conductive layer 2*a* are connected each other by way of bump 14 and conductive layer 13 that is formed on flip-chip packaging substrate 12, whereby the same effect as the second embodiment can be obtained. In addition, this embodiment provides the additional advantage that the filter characteristics can be adjusted when the filter substrate undergoes flip-chip packaging, thus eliminating additional frequency adjustment steps.

Although examples have described in the above-described embodiments in which the number of filter stages was three, the number of stages may be increased to obtain the desired characteristics. In addition, a configuration for regulating the inductance of the via-holes can also be applied to the frequency regulation of a single resonator that is used in a dielectric resonator/oscillator.

What is claimed is:

1. A dielectric waveguide filter, comprising:

an upper conductive layer and a lower conductive layer on the surfaces of a dielectric substrate; and conductors for connecting said upper conductive layer and said lower conductive layer to form a number, n, of filter stages comprising resonators and dielectric windows;

wherein the number, n, of filter stages is 3 or more, and first to $n^{th}$ resonators are successively coupled by electromagnetic fields and are also adjacent to respective resonators such that an $i^{th}$ resonator is coupled by an electromagnetic field to a $j^{th}$ resonator by a window coupling similar to said coupling between through said dielectric windows said resonators which are successively coupled, where $1 \leqq i < j \leqq n$ and $j \neq i+1$, wherein said resonators are formed by via-hole rows that connect said upper conductive layer and said lower conductive layer, and the spacing of via-holes that form the via-hole rows is less than or equal to ½ the guide wavelength of the resonance frequency.

2. A filter according to claim 1, wherein planar lines made up of slots are formed on said upper conductive layer and/or said lower conductive layer.

3. A filter according to claim 2, wherein said planar lines are coplanar lines made up of two coupled slots.

4. A dielectric waveguide filter, comprising:

an upper conductive layer and a lower conductive layer on the surfaces of a dielectric substrate; and rows of via-holes that connect said upper conductive layer and said lower conductive layer to form a number, n, of filter stages comprising resonators and dielectric windows;

wherein spacing of the via-holes that form the via-hole rows is less than or equal to ½ the guide wavelength of the resonance frequency, and wherein for at least one via-hole of the via-hole rows, a pad is formed so as to surround a periphery of the via-hole in the upper conductive layer and/or the lower conductive layer and to be separated from the upper conductive layer and/or the lower conductive layer by a slot, and wherein a conductive tab is used to connect the upper conductive layer and/or the lower conductive layer with the pad across the slot.

5. A filter according to claim 4, wherein said filter undergoes flip-chip packaging, and conductive tabs and bumps that are formed on a dielectric substrate for flip-chip packaging are used to connect the upper conductive layer and/or the lower conductive layer with the pad.

6. A filter according to claim 4, wherein the number, n, of filter stages is 3 or more, and first to $n^{th}$ resonators are successively coupled by electromagnetic fields and are adjacent to respective resonators such that an $i^{th}$ resonator is coupled to a $j^{th}$ resonator by an electromagnetic field, where $1 \leqq i < j \leqq n$ and $j \neq i+1$.

7. A filter according to claim 4, wherein planar lines made up of slots are formed in said upper conductive layer and/or said lower conductive layer.

8. A filter according to claim 7, wherein said planar lines are coplanar lines made up of two coupled slots.

* * * * *